US006755249B2

(12) United States Patent
Robison et al.

(10) Patent No.: US 6,755,249 B2
(45) Date of Patent: Jun. 29, 2004

(54) APPARATUS AND METHOD FOR PERFORATING A SUBTERRANEAN FORMATION

(75) Inventors: Clark E. Robison, Tomball, TX (US); Robert C. Pahmiyer, Houston, TX (US); Paul D. Ringgenberg, Spring, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/355,444

(22) Filed: Jan. 31, 2003

(65) Prior Publication Data

US 2003/0136562 A1 Jul. 24, 2003

Related U.S. Application Data

(62) Division of application No. 09/977,026, filed on Oct. 12, 2001.

(51) Int. Cl.[7] ..... E21B 43/112

(52) U.S. Cl. ..... 166/262; 166/55; 166/298; 166/307; 166/376; 166/381

(58) Field of Search ..... 166/262, 259, 166/308, 300, 376, 281, 55, 55.2, 55.3, 55.6, 55.7, 242.1, 297, 298, 207, 227, 305.1, 307, 296, 380, 381; 138/118, 177

(56) References Cited

U.S. PATENT DOCUMENTS

| | | | |
|---|---|---|---|
| 1,162,601 | A | 11/1915 | Graham |
| 1,247,140 | A | 11/1917 | Noble |
| 1,259,340 | A | 3/1918 | Baash |
| 1,272,597 | A | 7/1918 | Baash |
| 1,497,919 | A | 6/1924 | Layne |
| 1,500,829 | A | 7/1924 | Layne |
| 1,514,062 | A | 11/1924 | McLain |
| 1,532,592 | A | 4/1925 | Layne |
| 2,482,913 | A | 9/1949 | Jobe |
| 3,179,168 | A | 4/1965 | Vincent |

(List continued on next page.)

FOREIGN PATENT DOCUMENTS

| | | | |
|---|---|---|---|
| GB | 1050365 | | 12/1966 |
| GB | 1342954 | | 1/1974 |
| GB | 1483183 | | 8/1977 |
| GB | 2297107 | A | 7/1996 |
| GB | 2344606 | A | 12/1998 |

(List continued on next page.)

OTHER PUBLICATIONS

Phillip M. Snider and Robert Haney, A Review of Field Performance of New Propellant/Perforating Technologies, Society of Petroleum Engineers 56469, Oct. 1999, pp. 1–10, SPE, Houston, Texas.

(List continued on next page.)

*Primary Examiner*—David Bagnell
*Assistant Examiner*—Matthew J Smith
(74) *Attorney, Agent, or Firm*—Peter V. Schroeder

(57) ABSTRACT

Method and apparatus are presented for perforating a subterranean formation so as to establish fluid communication between the formation and a wellbore, the wellbore having casing cemented therein, the casing having a cement sheath therearound. The casing is perforated with a mechanical perforator and thereafter a propellant material is ignited within the casing thereby perforating the cement sheath. The formation may thereafter be stimulated with an acid stimulator. The mechanical perforator may include use of a toothed wheel, or a needle-punch perforator. The propellant may be deployed in a sleeve and may comprise an abrasive material.

67 Claims, 8 Drawing Sheets

U.S. PATENT DOCUMENTS

| | | | | | |
|---|---|---|---|---|---|
| 3,203,483 | A | | 8/1965 | Vincent | |
| 3,212,580 | A | | 10/1965 | Frogge | |
| 3,266,571 | A | | 8/1966 | St. John et al. | |
| 3,270,817 | A | | 9/1966 | Papaila | |
| 3,353,599 | A | | 11/1967 | Swift | |
| 3,477,506 | A | | 11/1969 | Malone | |
| 3,498,376 | A | | 3/1970 | Sizer et al. | |
| 3,669,190 | A | | 6/1972 | Sizer et al. | |
| 3,720,262 | A | | 3/1973 | Grable | |
| 3,746,091 | A | | 7/1973 | Owen et al. | |
| 3,776,307 | A | | 12/1973 | Young | |
| 4,095,825 | A | | 6/1978 | Butler | |
| 4,106,561 | A | | 8/1978 | Jerome et al. | |
| 4,165,784 | A | | 8/1979 | Gardner | |
| 4,182,418 | A | | 1/1980 | Jannsen | |
| 4,220,201 | A | | 9/1980 | Hauk | |
| 4,498,543 | A | | 2/1985 | Pye et al. | |
| 4,687,232 | A | | 8/1987 | Zimmerman | |
| 5,014,779 | A | | 5/1991 | Meling et al. | |
| 5,228,518 | A | * | 7/1993 | Wilson et al. | 166/369 |
| 5,355,956 | A | | 10/1994 | Restarick | |
| 5,361,843 | A | | 11/1994 | Shy | |
| 5,526,881 | A | * | 6/1996 | Martin et al. | 166/296 |
| 5,667,011 | A | | 9/1997 | Gill et al. | |
| 5,701,964 | A | | 12/1997 | Walker et al. | |
| 5,775,426 | A | | 7/1998 | Snider et al. | |
| 5,924,745 | A | | 7/1999 | Campbell | |
| 5,984,568 | A | | 11/1999 | Lohbeck | |
| 6,009,947 | A | | 1/2000 | Wilson et al. | |
| 6,012,523 | A | | 1/2000 | Campbell et al. | |
| 6,021,850 | A | | 2/2000 | Wood et al. | |
| 6,029,748 | A | | 2/2000 | Forsyth et al. | |
| 6,070,671 | A | | 6/2000 | Cumming et al. | |
| 6,082,450 | A | * | 7/2000 | Snider et al. | 166/55.2 |
| 6,095,247 | A | * | 8/2000 | Streich et al. | 166/299 |
| 6,457,533 | B1 | * | 10/2002 | Metcalfe | 166/381 |

FOREIGN PATENT DOCUMENTS

| | | |
|---|---|---|
| RU | 2101473 | 5/1996 |
| WO | WO 96/37680 | 11/1996 |
| WO | WO 97/17527 | 5/1997 |
| WO | WO 98/49423 | 11/1998 |
| WO | WO 99/56000 | 11/1999 |
| WO | WO 00/26500 | 5/2000 |
| WO | WO 00/26501 | 5/2000 |
| WO | WO 00/26502 | 5/2000 |

OTHER PUBLICATIONS

R. J. Whisonant And F. R. Hall, Combining Continous Improvements In Acid Fracturing, Propellant Stimulations, and Polymer Technilogies to Increase Production and Develop Additional Reserves in a Mature Oil Field, Society of Petroluem Enginners 38789, Oct. 1997, pp. 1–9, SPE Richardson, Texas.

P. M. Snider, F. R. Hall, And R. J. Whisonant, Experiences With High Energy Stimulations for Enhancing Near–Wellbore Conductivity, Society of Petroleum Engineers 35321, Mar., 1996m pp. 1–8 SPE, Richardson, Texas.

* cited by examiner

APPARATUS AND METHOD FOR PERFORATING A SUBTERRANEAN FORMATION

CROSS REFERENCE TO RELATED APPLICATIONS

This application is a divisional of U.S. patent application Ser. No. 09/977,026 filed on Oct. 12, 2001, which is incorporated herein by reference in its entirety.

TECHNICAL FIELD

This invention relates to new and improved methods of perforating a cemented well bore casing and the surrounding cement.

BACKGROUND OF THE INVENTION

In the process of establishing an oil or gas well, the well is typically provided with an arrangement for selectively establishing fluid communication with certain zones in the formation traversed by the well. A typical method of controlling the zones with which the well is in fluid communication is by running well casing into the well and then sealing the annulus between the exterior of the casing and the walls of the wellbore with cement. Often the casing is expanded once it is run-in to the well. Thereafter, the well casing and cement may be perforated using mechanical or chemical means at preselected locations by a perforating device or the like to establish a plurality of fluid flow paths between the pipe and the product bearing zones in the formation.

Much effort has been devoted to developing apparatus and methods of perforation. Explosive charges are sometimes used to construct perforating guns, such as disclosed in U.S. Pat. No. 5,701,964 to Walker et al. Attempts have been made to increase the effectiveness of explosive perforation methods by combining them with propellant fracture devices. An example of such attempts is disclosed in U.S. Pat. No. 5,775,426 to Snider, et al, wherein a sheath of propellant material is positioned to substantially encircle at least one shaped charge. Under this method, the propellant generates high-pressure gasses, which clean the perforations left by explosive charges.

Problems exist with the use of explosives to perforate casing, however. Unfortunately, the process of perforating through the casing and then though the layer of cement dissipates a substantial portion of the energy from the explosive perforating device and the formation receives only a minor portion of the perforating energy.

Further, explosives create high-energy plasma that can penetrate the wall of the adjacent casing, cement sheath outside the casing, and the surrounding formation rock to provide a flow path for formation fluids. Unfortunately, the act of creating the perforation tunnel may also create some significant debris and due to the force of the expanding plasma jet, drive some of the debris into the surrounding rock thereby plugging the newly created flow tunnel. Techniques have been developed to reduce the effect of the embedded debris, such as performing the perforation operation in an under-balanced condition or performing back-flushing operations following perforation.

Perforating in an under-balanced condition causes the formation fluids to surge into the wellbore yielding a cleaning effect. After perforating in an under-balanced condition the well must be "killed" by circulating out the produced fluids and replacing them with heavier completion fluids.

Oftentimes significant amounts of completion fluid are then lost to the formation, which can be expensive and potentially damaging to productivity. Fluid loss may result in formation damage due to swelling of formation clay minerals, particle invasion into the formation, dissolution of matrix cementation thereby promoting fines migration, and by interaction between the completion fluids and the formation fluids causing emulsion or water blocks or changes in the wetability of the formation sand. Fluid loss pills may also be required, which can be expensive and damaging.

Mechanical perforation may avoid many of these problems. Devices for mechanically perforating a well casing without the use of explosives are also known in the art and, in fact, predate the use of explosives. Laterally movable punches are exemplified by the devices shown in the Jobe, U.S. Pat. No. 2,482,913, Frogge, U.S. Pat. No. 3,212,580, Grable, U.S. Pat. No. 3,720,262, and Gardner, U.S. Pat. No. 4,165,784, which are each incorporated herein by reference. Toothed wheel perforators are exemplified by the devices showing in Graham, U.S. Pat. No. 1,162,601; Noble, U.S. Pat. No. 1,247,140; Baash, U.S. Pat. No. 1,259,340; Baash, U.S. Pat. No. 1,272,597; Layne, U.S. Pat. No. 1,497,919; Layne, U.S. Pat. No. 1,500,829; Layne, U.S. Pat. No. 1,532,592; Jerome, U.S. Pat. No. 4,106,561; and Hank, U.S. Pat. No. 4,220,201, which are each incorporated herein by reference.

It is also known in the art to run into a well a liner that is pre-perforated with the openings filled by shearable plugs. Such a device is exemplified by U.S. Pat. No. 4,498,543 to Pye, which is incorporated herein by reference.

Unfortunately, these mechanical and shearable plug methods of perforation are of limited use where the casing is cemented in place and these methods do not perforate the fluid bearing formation.

SUMMARY OF THE INVENTION

Method and apparatus are presented for perforating a subterranean formation so as to establish fluid communication between the formation and a wellbore, the wellbore having casing cemented therein, the casing having a cement sheath therearound. The casing is perforated with a mechanical perforator and thereafter a propellant material is ignited within the casing thereby perforating the cement sheath. The formation may thereafter be stimulated with an acid stimulator. The mechanical perforator may include use of a toothed wheel, or a needle-punch perforator. The propellant may be deployed in a sleeve and may comprise an abrasive material.

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION

Figure 3:
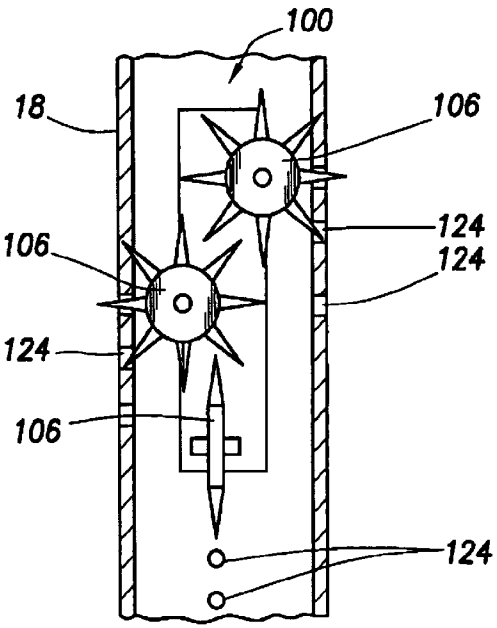
FIG. 3 is an elevational cross-sectional view of a multiple-wheeled mechanical perforator as described herein.

The present inventions are described by reference to drawings showing one or more examples of how the inventions can be made and used. In these drawings, reference characters are used throughout the several views to indicate like or corresponding parts. In the description which follows, like or corresponding parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole," "longitudinally," and the like, as used herein, shall mean in relation to the bottom, or furthest extent of, the surrounding wellbore even though the wellbore or portions of it may be deviated or horizontal. Correspondingly, the "transverse" or "radial" orientation shall mean the orientation perpendicular to the longitudinal orientation. In the discussion which follows, generally cylindrical well, pipe and tube components are assumed unless expressed otherwise.

Figure 1:
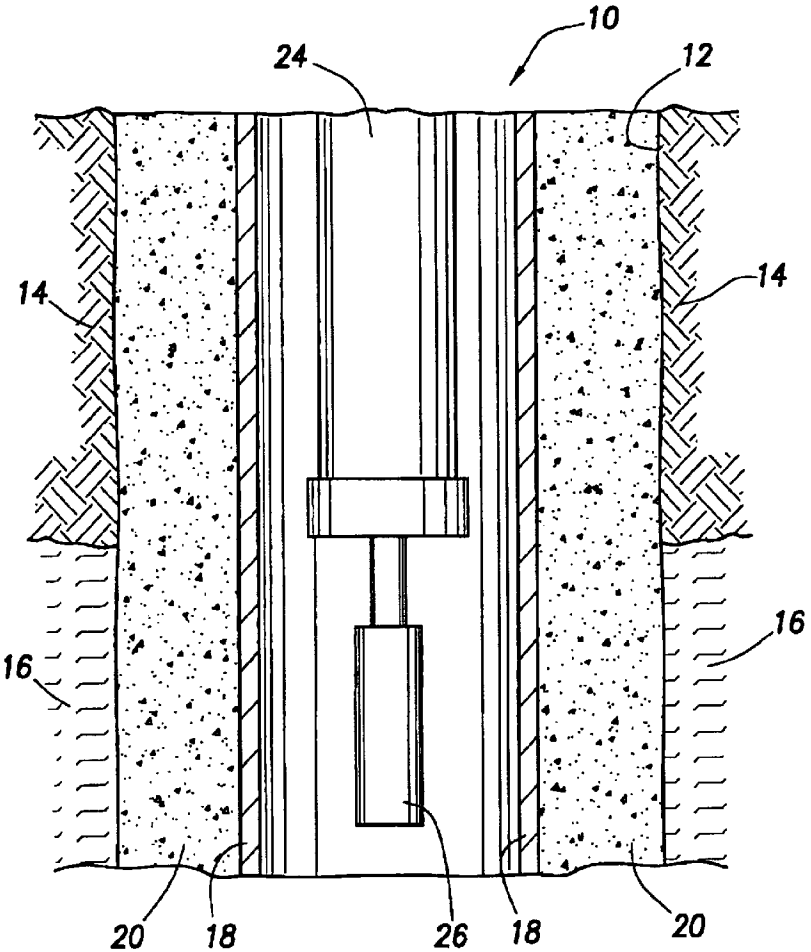
FIG. 1 is an elevational cross-sectional view of a downhole portion of a cased and cemented well.

FIG. 1 shows a portion of hydrocarbon well 10. Wellbore 12 extends through formation 14 having at least one producing, or hydrocarbon hearing, zone 16. To avoid communication with non-producing zones, wellbore 12 are typically cased and cemented and thereafter perforated along the producing zones. Wellbore 12 is lined with casing 18 and cement 20. Methods of cementing and casing are well known in the art. It is understood that the casing may be traditional or expandable casing. In the illustrated wellbore 12, a work string 24 has been run in, including tool subassembly 26, which may house mechanical, chemical or explosive perforators, or other well tools.

Mechanical Perforators:

Devices for mechanically perforating a well casing predate the use of explosives. Toothed wheel perforators are exemplified by the devices shown in U.S. Pat. No. 1,162,601 to Graham, U.S. Pat. No. 1,247,140 to Noble, U.S. Pat. No. 1,259,340 to Baash, U.S. Pat. No. 1,272,597 to Baash, U.S. Pat. No. 1,497,919 to Layne, U.S. Pat. No. 1,500,829 to Layne, U.S. Pat. No. 1,532,592 to Layne, U.S. Pat. No. 4,106,561 to Jermone, and U.S. Pat. No. 4,220,201 to Hank, each of which are incorporated herein in their entirety by reference for all purposes.

Figure 2:
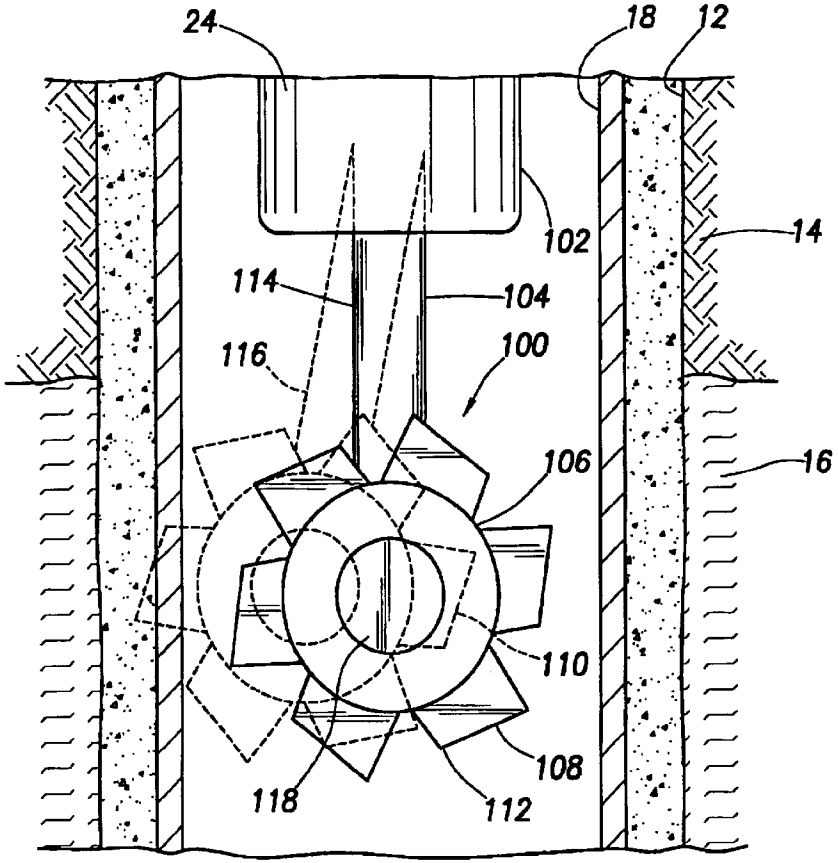
FIG. 2 is an elevational cross-sectional view of a mechanical perforator as described herein.

Referring to FIG. 2, a retractable-toothed perforator wheel 100 is fixed to the lower end of a work string 24 that has been lowered into the cased wellbore 12. The perforator is positioned within the casing 18 at the depth of the producing zone 16 of the formation 14.

The perforator 100 includes a main body 102, a wheel arm 104, and a cutter wheel 106 with a plurality of cutting teeth 108.

The cutter wheel 106 may be of any size to fit within the casing 18 and plurality of circumferentially spaced, generally radially cutter teeth 108 may be extendable, that is movable between a home position 110, as illustrated in FIG. 2, and a cutting position 112. The teeth 108, if extendable, are moveable via an appropriate actuating device 118 such as spring mountings, lever arms, piston assemblies or the like. Appropriate locking mechanisms may be necessary to maintain the teeth in the cutting position.

The wheel arm 104 pivots or otherwise moves, if necessary, to allow the cutting wheel to be moved between a run-in position 114 and an operable position 116, as illustrated in FIG. 2. The wheel arm 104 can be moved between the run-in position 114 and the operable position 116 by use of an arm actuator and may be spring-mounted, hydraulically or air driven, electrically actuated or by any other means known.

In operation, the perforator 100 is lowered into the wellbore 12 with the wheel arm in the run-in position 114 such that the cutter does not contact the casing 18. The teeth 108, if extendable, are preferably in the home position 110 during run-in operations with all of the teeth 108 spaced inwardly from the casing. The exterior of the wheel 106 is similarly spaced away from the casing. The perforator 100 is lowered to a desired depth adjacent the production zone 16 where the teeth 108 are extended to the cutting position 112. The wheel arm 104 is then moved such that the wheel 106 is brought into contact with the casing 18. Preferably, the entire perforator is then pulled uphole by raising the work string 24. It is understood that the cutter tool can be operated in a top-down method. The cutter wheel 106 is forced to rotate, driving the teeth 108 into and through the casing 18. The entire perforator 100 is raised the desired distance along the production zone 16 to provide a line of perforations along this length. Once the desired length of perforations is completed, the cutter wheel 106 and arm 104 are returned to their run-in positions. The perforator can then be rotated and moved within the casing and one or more addition lines of perforation made, as desired.

One of the drawbacks of mechanical perforation is the time and expense involved in making the multiple trips up and down the casing needed to perforate an adequate number of rows of holes in the casing wall. This is especially true where perforation is desired over a lengthy vertical interval of the wellbore. FIG. 3 shows an arrangement of multiple cutter wheels 106 configured on a single perforator tool 100. The multiple wheels 106 are arranged to produce multiple rows of perforations 124 along the casing wall 18. FIG. 3 shows three separate cutting wheels 106, but it is understood that greater or fewer wheels can be used as desired. The multiple wheels may employ pivot arms, retractable teeth, and various actuators and locking mechanisms and other mechanisms as are known in the art as needed.

Figure 4:
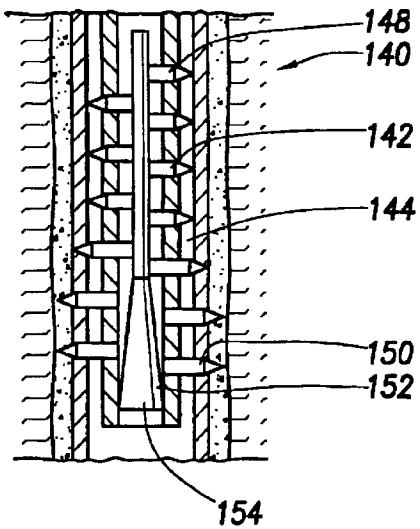
FIG. 4 is an elevational cross-sectional view of a needle-punch perforator as described herein.

FIG. 4 shows a needle-punch perforator 140 having a plurality of movable needles 142 supported on a perforator body 144. The needles are movably mounted to the perforator and extend in a generally radial direction. The needle-punch perforator 140 is run-in to the casing 18 to a desired depth with the needles 142 in a retracted position 148 such that the needles do not interfere with movement of the tool 140. The needles are preferably directed radially outward when in the run-in, or retracted, position, as shown, but can be mounted to point in any direction so as not to interfere with the run-in procedure. Once the perforator 140 is positioned within the production zone 16, the needles 142 are moved to an extended position 150 wherein the needles 142 perforate the casing wall 18. Extension of the needles 142 is accomplished via an actuating means 152. FIG. 4 shows a substantially conical expansion plug 154 which, when pulled through the perforator body 144, forces the plurality of needles 142 outward and through the casing 18. The needles 142 can slide through holes in the perforator body 144, as shown, or the perforator body 144 itself, or moveable parts thereof, may expand carrying the needles 142 thereon.

After perforation of the casing, the needles can be retracted from the casing and withdrawn, along with the perforator, from the wellbore. Alternately, the needles can be sheared or otherwise broken off from the perforator and left in place in the casing wall. In such a case, the needles can then be dissolved in an acid solution injected into the wellbore.

The perforator tools shown in the various figures may be used separately or in conjunction with one another or other well tools. It may be desirable to combine the perforator run-in with the run-in for other well tools. The complexity of the system may outweigh the advantages of combining multiple operations in a single trip, however, all of the methods of perforation described herein may be performed in either a bottom-up or top-down method. The perforators may be used in wellbores which have been cemented or are not cemented or with traditional or expandable casing. In the case of cemented casing, the mechanical perforators may have teeth which perforate into or through the cemented portion surrounding the casing. More typically, the teeth will perforate the casing wall but not through the entire thickness of the cement sheath. Other methods may be used to perforate through the cement and, if desired, to fracture the formation itself, as described herein.

Pre-Perforated Casing:

Among the many types of downhole well completions is one in which a pre-perforated liner, screen or casing is positioned adjacent the production zone. The pre-perforated liner may be left sitting unsupported in the open hole, or the annular space between the wellbore and the outside of the pre-perforated liner can be filled with a permeable material, such as a gravel pack, or the space may be filled with cement which must later be perforated. Pre-perforated liners can be especially useful where the wellbore sidewall material is poorly consolidated or contains or is composed of shale, clays, silicates and the like and the produced or injected fluids contain or are composed of water.

Difficulties have been experienced in running pre-perforated liners into wells, especially wells penetrating reservoirs containing high-pressure fluids, more particularly high temperature geothermal fluids and most particularly dry geothermal steam wells. When attempts have been made to run a pre-perforated liner into such wells, the high pressure formation fluids quickly pass through the perforations and up the liner to the surface where they escape, resulting in considerable danger to the workmen running the liner.

It has been the practice in the past to first inject into the well a fluid, in sufficient volume to provide hydrostatic head to counterbalance the formation pressure and "kill" the well. The perforated liner can then be safely run into the well and the injected water subsequently removed. However, this manner of killing the well has not been satisfactory since the reason for running the liner in the first place is that the wellbore may contain shale or similar unstable materials. These materials can swell and collapse into the open hole as soon as contacted by the injected water. Thus, the wellbore becomes restricted with detritus and the liner cannot be lowered into place.

In certain well operations, such as in cementing casing, it is known to run into a well pre-perforated liner whose openings have been filled with plugs, and to later run a cutting tool down the liner to remove the plugs and open the openings in the liner. Such a method is described in U.S. Pat. No. 4,498,543 to Pye, which is incorporated herein by reference.

It is also known in the art to run into a wellbore pre-perforated base pipe having a protective shell over a well screen, the shell having openings which have been filled with a sacrificial material, for example, zinc, aluminum and magnesium. The sacrificial plugs temporarily prevent dirty completion fluid from passing through the pre-perforated screen shell as it is run in to the wellbore, thereby protecting the screen from plugging. After the screen assembly is in place downhole, the shell plugs are dissolved by an acid or other corrosive solution, for example, hydrogen chloride (HCL) or hydrogen fluoride (HF), or by a caustic solution such as sodium hydroxide (NaOH) or potassium hydroxide (KOH). The specific acid or caustic solution used is determined in part by the characteristics of the well. After dissolution of the plugs, further well operations can be carried out. Such a system is described in U.S. Pat. No. 5,355,956 to Restarick and is incorporated herein by reference.

It has become common to insert expandable casing into wellbores. The casing, in its smaller diameter pre-expanded state, is run into the wellbore to a desired depth. The casing is then expanded, usually by pulling a specially designed expansion plug through the casing, to a larger diameter expanded state. If it is desired to cement the expandable casing in place, cement is placed in the annular space between the casing and the wellbore. Typically the cement is placed where desired in a slurry, or "wet" form, and the casing is then expanded prior the cement drying or "setting." This helps ensure that the annular cavity is properly filled with cement. Unfortunately, the shearable and dissolvable plugs tend to tear, break or pull away from the casing during the expansion process.

Figure 5B:
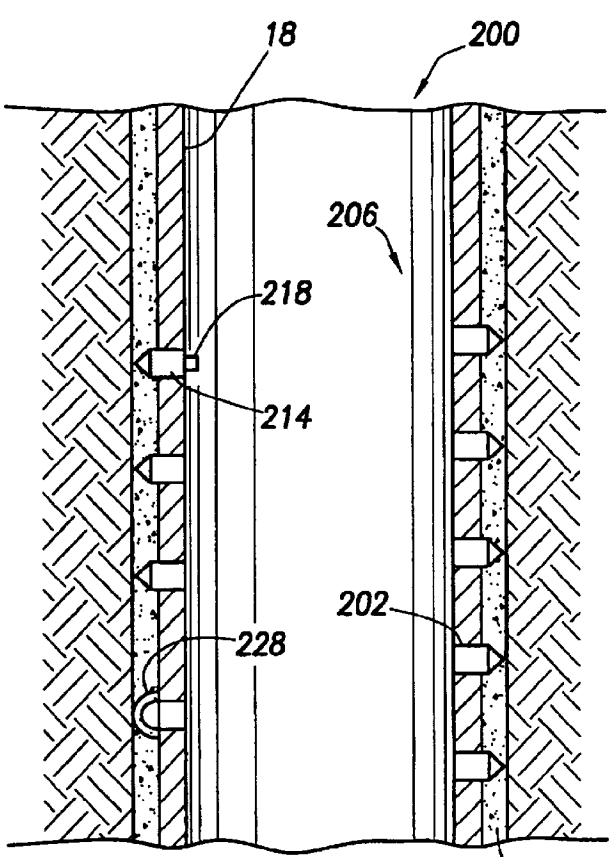
FIGS. 5A and 5B are elevational cross-sectional views of a perforation method described herein.
Figure 5A:
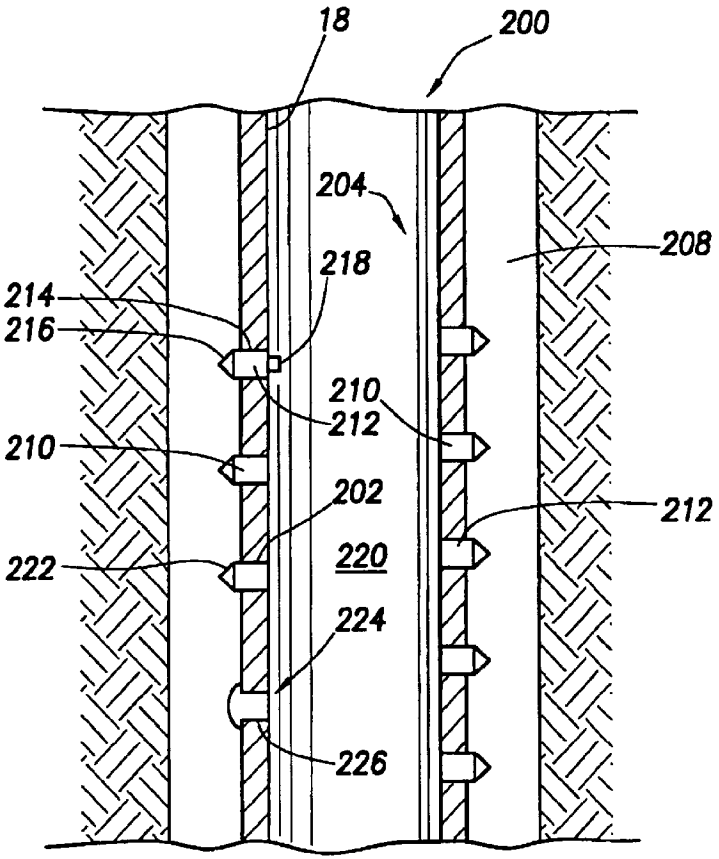

FIGS. 5A and 5B show a pre-perforated assembly 200 having a casing 18 which has pre-formed holes or perforations 202 in the wall thereof. The casing 18 is expandable and is run-in to the wellbore 12 in an unexpanded state 204, as seen in FIG. 5A, then expanded, by means known in the art, to an expanded state 206, as seen in FIG. 5B. Cement 20 is placed into the space 208 between the wellbore wall and the exterior of the casing 18, typically prior to expansion of the casing. The casing 18 is typically expanded before the cement 20 has hardened or "set." The perforations 202 are temporarily sealed by sacrificial plugs 210. In one embodiment, each plug 210 is fabricated from a sacrificial metal such as zinc, aluminum and magnesium, which may be dissolved when contacted by a high pH acid or a low pH base solution. It is desirable that the metal selected be characterized by a relatively faster rate of etching or dissolution when contacted by an acid or base solution, as compared to the rate that the casing 18 is affected.

The plugs 210 can be threadingly engaged, friction fit or otherwise secured with casing perforations 202. During initial assembly, each perforation 202 is sealed by engagement of the plugs 210. The thickness of the plug 210 is selected so that it will be completely dissolved within a predetermined period of exposure to a corrosive, acid solution or base solution, for example, for four hours. As the plugs 210 dissolve, the perforations 202 are opened up to permit the flow of formation fluid through the casing 18. In this embodiment, the plugs 210 may be hollow, having a relief pocket 212 therein, or may be solid. If used with expandable casing, the plugs 210 must be robust to expand with the casing without breaking. Examples of suitable materials include: aluminum, brass, bronze, and fiberglass reinforced epoxy resin.

Additionally, the plugs can be made of rubber, plastic or other material which is solid at low temperatures but melts or dissolves over time when exposed to higher temperatures.

In another embodiment, the perforations 202 are temporarily sealed by plugs 210 which are shearable. A shearable plug 214 is shown in FIGS. 5A and 5B. Although dissolvable and shearable plugs can be used simultaneously, this would be highly unusual. Shearable plug 214 has a body portion 216 intersected by a relief pocket 212, which is sealed, by a stub portion 218. The relief pocket 212 extends partially into stub portion 218. The stub portion 218 projects radically into the bore 220 of the casing 18. Once the casing 18 is in place, the perforations 202 are opened mechanically by shearing the shearable plugs 214. This is performed with a milling tool, which is run on a concentric tubing string. The stub portion 218 is milled, thereby opening relief pocket 212. Alternatively, the plugs are removed by flooding the bore of the screen mandrel 18 with an acid solution, so that the plugs are dissolved. In that arrangement, the plugs are constructed of a metal, which dissolves readily when contacted by an acid solution, for example, zinc, aluminum and magnesium. Zinc is the preferred metal since it exhibits the fastest dissolving rate. Where the plugs 214 are to be sheared, the plugs can be made of any solid material. Particularly suitable are materials which are capable of withstanding considerable fluid pressure differential yet can be rather easily cut or broken. Examples of suitable materials include steel, cast iron, aluminum alloys, brass and plastics.

Plugs 210 preferably have a wellbore protrusion 222 which projects radially outward from casing 18 into the wellbore area. Such protrusions 222 may be used with plugs of dissolvable design 210 or shearable design 214. The protrusions 222 can be sized to contact the wellbore surface, as shown in FIG. 5B. If protrusions 222 are utilized on expandable casing, the plugs 210 must be of a robust material capable of expansion and appropriately sized to expand with the casing 18. Examples of suitable materials include: steel, cast iron, aluminum alloys, brass and plastics.

In another embodiment, the plugs 210 are reactive plugs 224, as shown in FIGS. 5A and 5B. Again, it would be unlikely to simultaneously employ soluble plugs 210, shearable plugs 214 and/or reactive plugs 224, but all are included in FIGS. 5A and 5B for ease of reference. Reactive plugs 224 can employ protrusion 222, as can the other types of plugs.

Each reactive plug 224 can be mounted in a pre-formed recess 226 in the casing 18 or otherwise connected to the casing. As the casing 18 is expanded, the reactive plugs 224 expand as well. In the presence of a pre-selected additive 228, which can be introduced downhole independently or as part of the cement slurry, the reactive plugs 224 expand to many times their original size and in a prescribed geometric pattern. The expanded reactive plugs 224 would thereby create perforation tunnels into and/or through the cement 20.

After the reactive plugs 224 have expanded and the cement 20 has set, the reactive plugs 224 can be dissolved in a suitable fluid.

The reactive plugs 224 can be made of any suitable material which will expand in the presence of an additive, as is known in the art. For example, the plugs 224 can be made of an elastomer, such as EPDM (Ethylene Propylene) which swells in the presence of diesel. Appropriate plug material, additives, and solvents can be selected as well conditions demand.

Figure 6A:
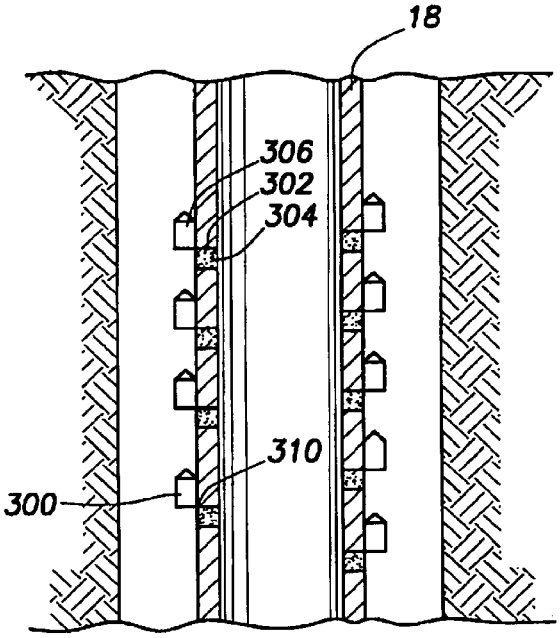
FIG. 6A is an elevational cross-sectional view of a perforation method described herein.
Figure 6B:
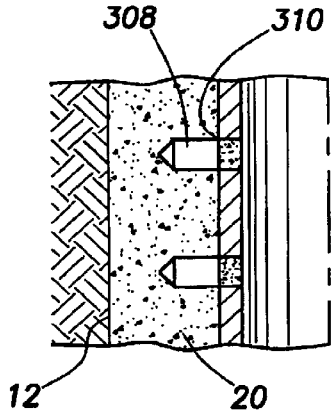
FIG. 6B is a detail of said a step of method.
Figure 6C:
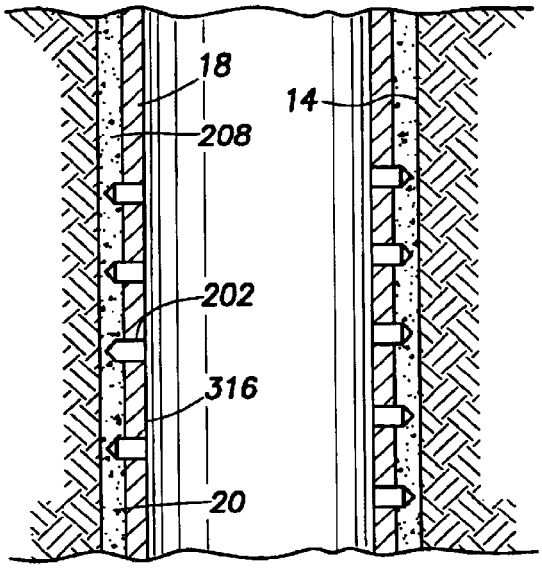
FIG. 6C is an elevational cross-sectional view of a perforation method described herein.

FIGS. 6A–6H show a pre-perforated casing 18 having extendable perforation "fingers" 300, or darts, mounted thereon. The fingers 300 are attached to the outside of casing 18 in a run-in position 306, as seen in FIG. 6A. Pre-formed perforations 302 are temporarily plugged with plugs 304. Once the perforated casing is in place in the wellbore, the fingers 300 are moved to an extended position 308, as seen in FIG. 6B. Cement 20 is placed into the wellbore 12 and the casing 18 is expanded prior to the cement setting. As the casing 18 is expanded, the fingers 300 contact the wellbore 12 and are forced radially inward, thereby piercing the temporary plugs 304, and moving to a final position 316 as seen in FIG. 6C.

Figure 6D:
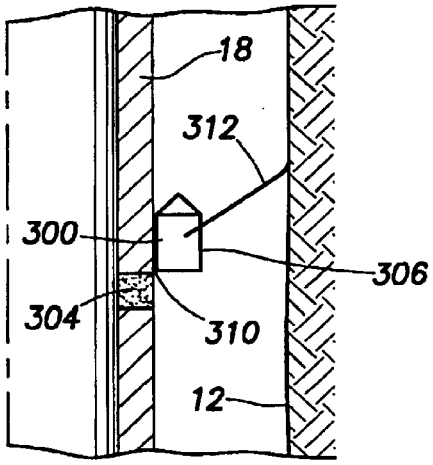
FIG. 6D is a detail of an embodiment which maybe employed in said method.
Figure 6E:
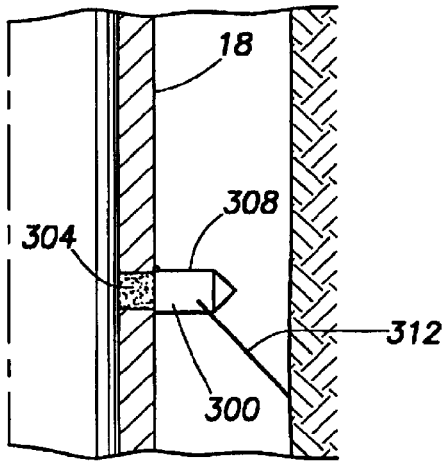
FIG. 6E is a detail of an embodiment which may be employed in the method.

The fingers 300 can be hinged, tagged or otherwise attached to the casing 18 at attachment means 310. The fingers 300 are movable between the run-in position 306 and the extended position 308. Movement between the positions 306 and 308 may be achieved by any means known in the art. For example, the drill tool string bearing the perforated casing can be rotated creating a centrifugal force, which rotates the fingers from the run-in to the extended position. As another example, the darts 300 may have a wire 312, as shown in FIG. 6D, extending radially outward from the dart 300 and also extending uphole. The wire 312 contacts the wellbore 12. As the perforation tool is run-in to the wellbore 12 the wire 312 simply drags along the wellbore wall, bending as necessary so as not to affect the run-in procedure. Once the tool has reached the desired depth in the wellbore 12, the tool is pulled uphole a short distance, where the wire 312 contacts the wellbore wall "bites" into the wall. The casing 18 is moved uphole, but the wire 312 maintains its position in the wellbore, thereby forcing the dart 300 to rotate downward into an extended position 308, seen in FIG. 6E. The same procedure can be used with a textured surface on the exterior of the dart, where the texturing allows free downhole movement but "bites" upon uphole movement of the tool string.

Figure 6F:
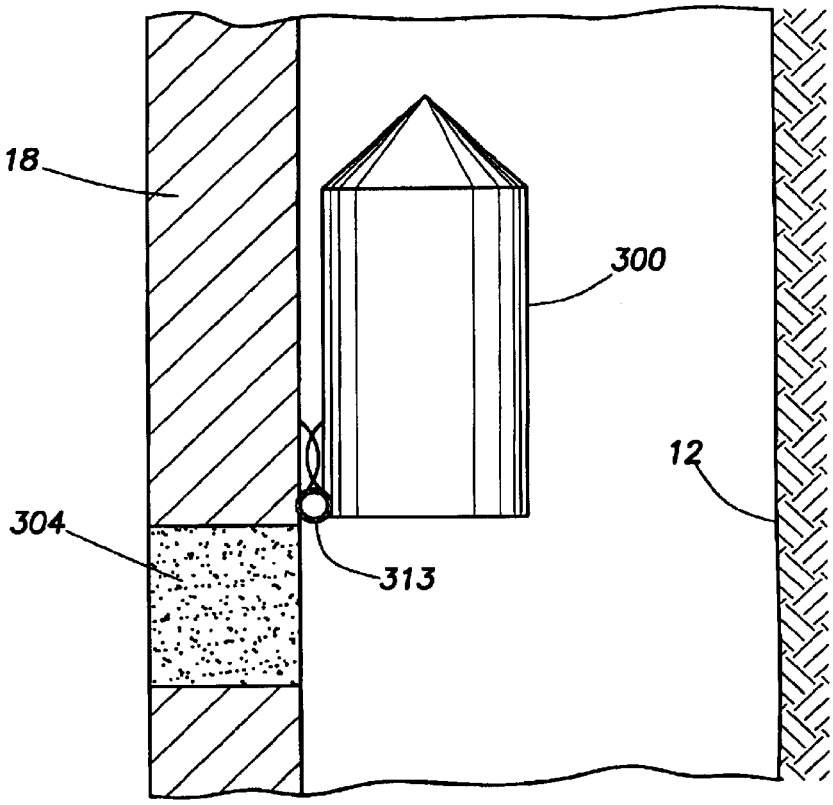
FIG. 6F is a detail of an embodiment which may be employed in the method.
Figure 6H:
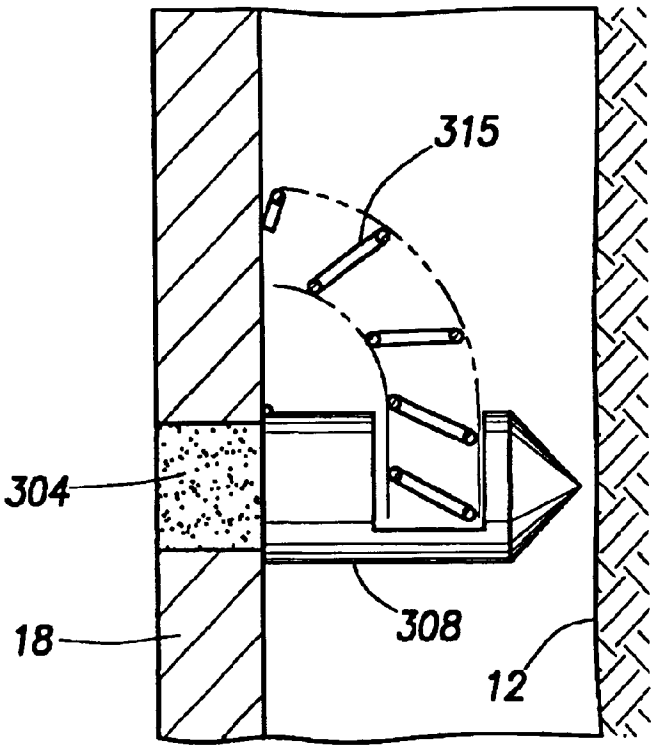
FIG. 6H is a detail of an embodiment which may be employed in the method.
Figure 6G:
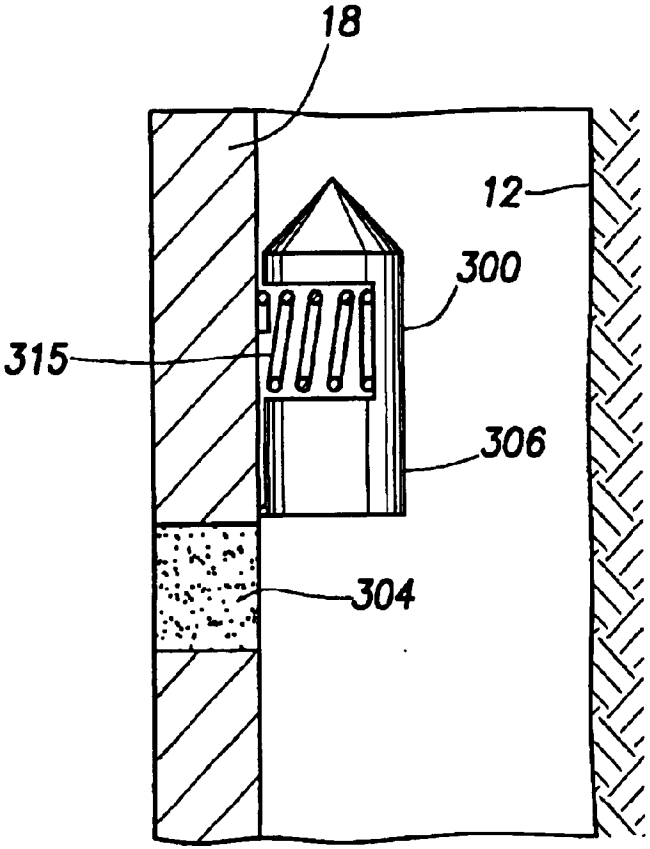
FIG. 6G is a detail of an embodiment which may be employed in the method.

An alternative embodiment employing a spring device 314 is shown in FIGS. 6F–6H. FIG. 6F employees a torsion spring device 313 capable of rotating the dart 300. FIGS. 6G 6H illustrate use of a coil spring device 315 rotating the dart 300 between a run-in position 306 (FIG. 6G) and an extended position 308 (FIG. 6H). Other methods of moving darts 300 between run-in and extended positions will be readily apparent to those skilled in the art.

Temporary plugs 304 may be pierced when the fingers 300 are rotated to the extended position 308 or when the fingers 300 are forced radially inward to a final position 316 by contact with the wellbore. Temporary plugs may be made of aluminum, brass, bronze, and fiberglass reinforced epoxy resin.

Propellants:

Following the perforation methods described herein, the casing 18 has perforations extending through the walls thereof. In some instances, for example, as shown in FIG. 5B, the perforations extend into the cement sheath 20 and perhaps extend to the wellbore wall 12. Where the perforations do not extend through the cement sheath, it is necessary to fracture the cement sheath and in any case it is necessary to fracture the formation. In a sand control environment, it may be desirable to place holes in the casing but not through the cement sheath so that the cement acts as a fluid loss control device during subsequent activity.

Figure 7A:
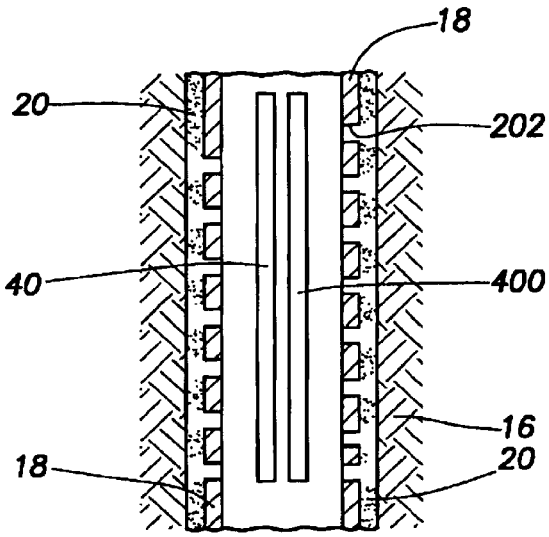
FIG. 7A is a cross-sectional view of a propellant deployed in perforated casing.

Fracturing may be accomplished several ways. Propellant 400 is deployed downhole adjacent perforations 202. As seen in FIG. 7A, the propellant 400 can be deployed as part of the completion in "stick" or "sleeve" form. The propellant 400 is then ignited in a manner similar to the tubing conveyed perforating methods which are known in the art. The propellant 400 can also be deployed via wireline after completion equipment is in place or by any other method known in the art.

Upon ignition, the propellant 400 will vacate the casing 18 through perforations 202, thereby cleaning the perforations, and fracture the cement sheath 20 and the formation zone 16.

Figure 7B:
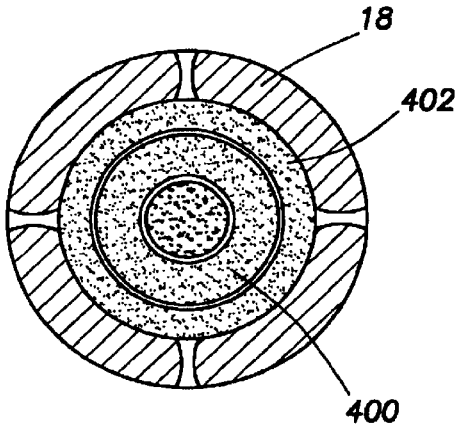
FIG. 7B is a top-view cross-section of a propellant and abrasive particulate deployment system.
Figure 7C:
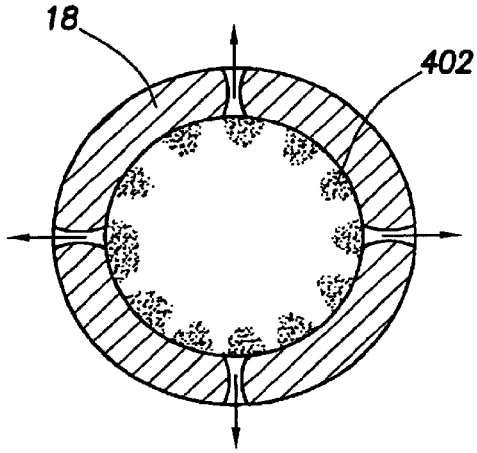
FIG. 7C is a top-view cross-section of the system of FIG. 7B during deployment.

The propellant 400 can also be deployed in combination with an abrasive particulate 402, as shown in FIG. 7B, and as known in the art. Including erosive or abrasive particulate 402 with the high-energy fluid stream of the ignited propellant 400 enhances scouring of the cement sheath 20 and formation 16. At the time of detonation, and in some cases, for a few seconds thereafter, the particulate matter 402 is expelled into the formation as seen in FIG. 7C. The particulate 402 abrades and penetrates the cement sheath and the formation, thereby creating flow connectivity.

Figure 7D:
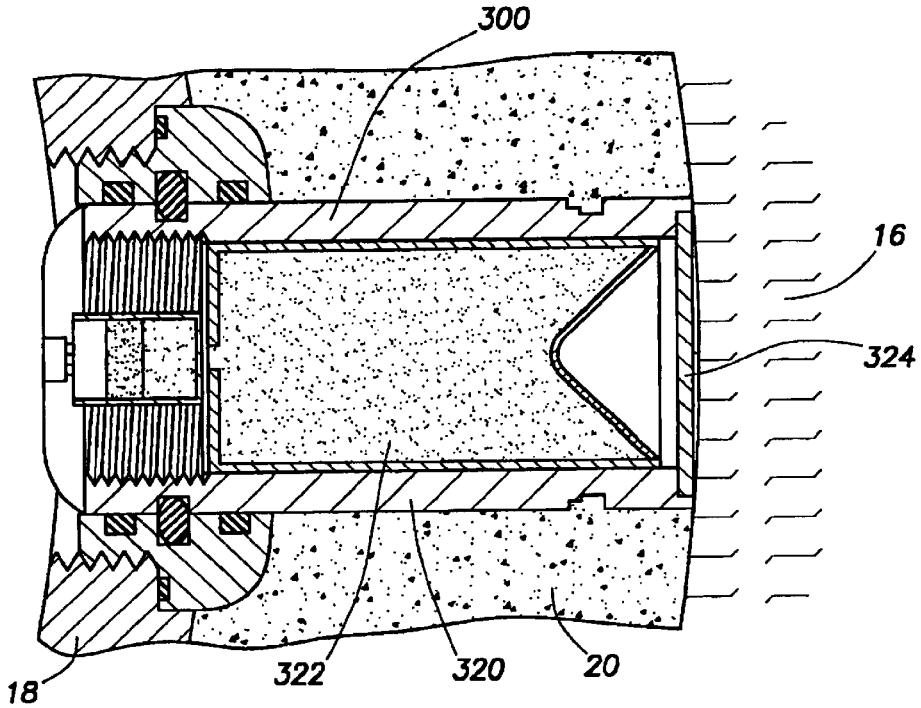
FIG. 7D is an elevational cross-sectional detail of FIG. 6C.

Another method of perforation is possible in the perforation method shown in FIG. 6C, or in any perforation application employing extendable fingers or darts. The fingers 300 can include an explosive charge for perforating formation zone 16, as seen in FIG. 7D. The finger 300 has a barrel portion 320 which extends radially from casing 18 into cement sheath 20 and preferably to formation zone 16. Barrel 320 houses an explosive perforating device 322 which may include initiators, detonators and charges as in known in the art. Once the fingers 300 are deployed in the extended position 308, the perforating device 322 is ignited and perforates zone 16.

Figure 7E:
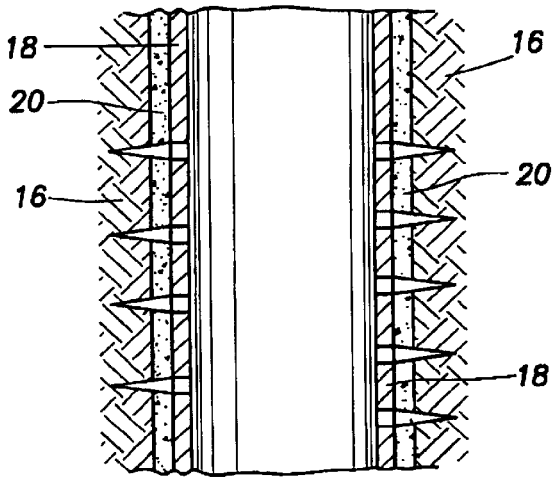
FIG. 7E is an elevational cross-sectional representation of a perforated and acid washed formation.

Alternately, the extended fingers 300 can act as nozzles, directing the ignited propellant from a propellant sleeve deployed in the casing. When the propellant is ignited it penetrates the tips 324 of the fingers 300 and fractures the formation zone 16 as shown in FIG. 7E.

Figure 8:
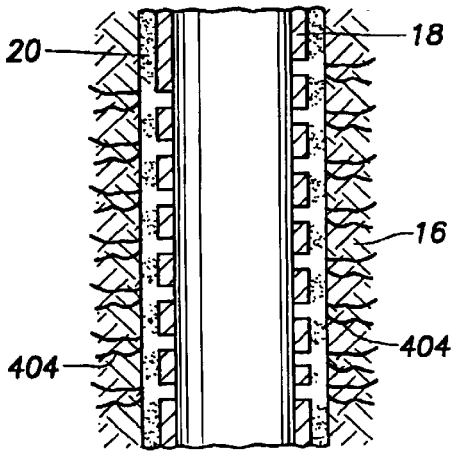
FIG. 8 in an elevational cross sectional representation of a perforated, ignited propellant fractured, and acid stimulated formation.

Acid Stimulation:

It may be desirable, after perforation and ignition of the propellant, to stimulate the formation by displacing an acid 404 into the formation 16 to enhance flow connectivity as shown in FIG. 8. Use of acid stimulation to enhance connectivity is known in the art, and any type of acid stimulation and method of deployment known in the art maybe employed.

Having thus described our invention, it will be understood that such description has been given by way of illustration and example and not by way of limitation, reference for the latter purpose being had to the appended claims.

What is claimed is:

1. A well casing apparatus for a subterranean formation which is penetrated by a wellbore, the casing comprising:

a substantially tubular casing having a casing wall with a plurality of perforations therethrough; and a plurality of sacrificial plugs secured to the casing wall and sealing the plurality of perforations, wherein the casing is radially expandable when in the wellbore, and the plugs remain secured to the casing wall, sealing the plurality of perforations, when the casing is expanded in the wellbore.

2. An apparatus as in 1 wherein the sacrificial plugs are soluble in an acid or caustic solution.

3. An apparatus as in 2 wherein the plugs comprise aluminum.

4. An apparatus as in 1 wherein the sacrificial plugs are soluble in an acid or caustic solution.

5. An apparatus as in 4 wherein the plugs comprise aluminum.

6. An apparatus as in 1 wherein the sacrificial plugs are shearable.

7. An apparatus as in 6, the casing wall enclosing a casing bore, and wherein each plug has a body portion engaging the casing wall and having a stub portion protecting into the casing bore, the body portion intersected by a relief pocket.

8. As in 1 wherein the sacrificial plugs further comprise a wellbore protrusion projecting into the wellbore.

9. An apparatus as in 8 wherein the plug protrusions comprise EPDM ethylene propylene.

10. An apparatus as in 1 wherein the sacrificial plugs comprise reactive plugs.

11. An apparatus as in 10 wherein the reactive plugs are mounted to the casing wall in preformed recesses therein.

12. An apparatus as in 10 wherein the reactive plugs comprise an elastomer.

13. An apparatus as in 10 wherein the reactive plugs expand in a prescribed geometric pattern in the presence of a pre-selected additive.

14. An apparatus as in 13 wherein the reactive plugs expand in the presence of diesel.

15. An apparatus as in 10 wherein the reactive plugs dissolve in an acid or caustic solution.

16. A method of completing a well having a wellbore penetrating a subterranean formation, the method comprising the steps of:

placing a substantially tubular casing having a casing wall enclosing a casing bore, the casing wall having a plurality of sacrificial plugs secured to the casing wall and sealing the plurality of perforations;

rupturing the sacrificial plugs, thereby establishing fluid communication between the wellbore and the casing bore; and expanding the casing and sacrificial plugs such that the plugs remain secured to the casing wall and seal the plurality of perforations during expansion of the casing and plugs.

17. A method as in 16 further comprising the step of cementing the casing in the wellbore.

18. A method as in 17 the step of cementing creating a cemented sheath around the casing, and wherein the plugs comprise protrusions projecting into the wellbore and into the cement sheath.

19. A method as in 17 wherein the plugs are reactive plugs and further comprising the step of expanding the reactive plugs such that a protruding portion of each of the plugs projects into the wellbore and into the cement.

20. A method as in 17 wherein the reactive plugs expand in the presence of a preselected additive.

21. A method as in 20 wherein the step of cementing further comprises the step of placing the additive into the wellbore adjacent the plugs in the casing.

22. A method as in 21 wherein the reactive plugs are an elastomer and the additive is diesel.

23. A method as in 19 further comprising the step of dissolving the reactive plugs after the step of expanding the reactive plugs.

24. A method as in 24 of completing a well having a wellbore penetrating a subterranean formation, the method comprising the steps of:

placing a substantially tubular casing having a casing wall enclosing a casing bore, the casing wall having a plurality of sacrificial plugs secured to the casing wall and sealing the plurality of perforations;

rupturing the sacrificial plugs, thereby establishing fluid communication between the wellbore and the casing bore; and expanding the casing and sacrificial plugs such that the plugs remain secured to the casing wall and seal the plurality of perforations during expansion of the casing and plugs wherein the step of rupturing the plugs further comprises dissolving the plugs.

25. A method as in 24 wherein the plugs are dissolved in an acid solution.

26. A method as in 24 wherein the plugs comprise aluminum.

27. A method as in 24 wherein the step of rupturing the plugs comprises shearing a portion of the plugs.

28. A method as in 27 wherein the plugs each comprise a body portion secured to the casing wall and stab portion projecting in to the casing bore, the body portion intersected by a relief pocket.

29. A method as in 27 wherein the plugs each comprise a protrusion extending into the wellbore.

30. An apparatus for completing a well in a subterranean formation penetrated by a wellbore, the apparatus comprising:

a casing having a casing wall, the casing being expandable;

a plurality of perforations through the casing wall;

a plurality of plugs corresponding to the plurality of perforations, the plugs sealing the plurality of perforations; and a plurality of extendable fingers secured to the casing wall adjacent the plurality of the perforations, each of the fingers movable between a run-in position wherein the fingers do not interfere with the casing being run-in to the wellbore, and an extended position wherein the fingers project radially from the casing wall.

31. An apparatus as in 30 wherein each of the fingers is movable between the extended position and a final position wherein each finger pierces a corresponding plug.

32. An apparatus as in 30 wherein each finger comprises an explosive charge for perforating the subterranean formation.

33. An apparatus as in 30, the casing wall enclosing a casing bore, and further comprising a propellant subassembly in the casing bore ignitable to vacate the casing bore through the plurality of perforations.

34. The apparatus as in 30, wherein each finger is pivotally attached to the casing wall.

35. The apparatus as in 30, wherein a wire extends from each finger, the wire for engaging the wellbore and moving the finger between the run-in and the extended positions.

36. The apparatus as in 30, the fingers movable between the run-in and extended positions by a spring device.

37. The apparatus as in 36, wherein the spring device is a torsion spring device.

38. A method of perforating a subterranean formation which is penetrated by a wellbore, so as to establish fluid communication between the formation and the wellbore, the method comprising the steps of:

running a casing into the wellbore, the casing having a casing wall, a plurality of perforations through the casing wall, a plurality of plugs sealing the plurality of perforations, and a plurality of fingers secured to the casing wall adjacent the plurality of perforations, the fingers in a run-in position wherein the fingers do not interfere with running the casing into the wellbore;

radially expanding the casing:

moving each of the plurality of fingers to an extended position wherein each finger projects radially outward from the casing wall; and thereafter igniting a propellant, the propellant exiting through the plurality of perforations and the plurality of fingers thereby perforating the formation.

39. A method as in 38 wherein the propellant is mounted in the plurality of fingers.

40. A method as in 38 wherein the propellant is disposed in the casing.

41. A method as in 40 further comprising the step of running a propellant subassembly into the casing.

42. A method as in 38 further comprising the step of cementing the casing in the wellbore.

43. A method as in 38 further comprising the step of moving each of the plurality of fingers from the extended position to a final position wherein each of the fingers pierces a corresponding plug.

44. A method as in 43, the step of moving the fingers to a final position further comprising expanding the casing such that the fingers contact the wellbore wall.

45. A method as in 38 wherein each finger is pivotally attached to the casing wall.

46. A method as in 38 wherein a wire extends from each finger, the wire for engaging the wellbore and moving the finger between the run-in and the extended positions.

47. A method as in 38 the fingers movable between the run-in and extended positions by a spring device.

48. A method as in 47 wherein the spring device is a torsion spring device.

49. A method of completing a well having a wellbore penetrating a subterranean formation, the method comprising the steps of:

placing a substantially tubular casing having a casing wall enclosing a casing bore, the casing wall having a plurality of reactive plugs secured to the casing wall and sealing the plurality of perforations;

rupturing the reactive plugs, thereby establishing fluid communication between the wellbore and the casing bore;

expanding the casing and reactive plugs such that the plugs remain secured to the casing wall and seal the plurality of perforations during expansion of the casing and plugs;

further comprising the step of cementing the casing in the wellbore; and expanding the reactive plugs such that a protruding portion of each of the plugs projects into the wellbore and into the cement.

50. A method as in 49 wherein the reactive plugs expand in the presence of a preselected additive.

51. A method as in 49 wherein the step of cementing further comprises the step of placing the additive into the wellbore adjacent the plugs in the casing.

52. A method as in 51 wherein the reactive plugs are an elastomer and the additive is diesel.

53. An apparatus for completing a well in a subterranean formation penetrated by a wellbore, the apparatus comprising:

a casing having a casing wall, the casing being expandable;

a plurality of perforations through the casing wall;

a plurality of plugs corresponding to the plurality of perforations, the plugs sealing the plurality of perforations;

a plurality of extendable fingers secured to the casing wall adjacent the plurality of the perforations, each of the fingers movable between a run-in position wherein the fingers do not interfere with the casing being run-in to the wellbore, and an extended position wherein the fingers project radially from the casing wall; and wherein each of the fingers is movable between the extended position and a final position wherein each finger pierces a corresponding plug.

54. An apparatus as in 53 wherein each finger comprises an explosive charge for perforating the subterranean formation.

55. An apparatus as in 53 the casing wall enclosing a casing bore, and further comprising a propellant subassembly in the casing bore ignitable to vacate the casing bore through the plurality of perforations.

56. An apparatus as in 53 wherein each finger is pivotally attached to the casing wall.

57. An apparatus as in 53 wherein a wire extends from each finger, the wire for engaging the wellbore and moving the finger between the run-in and the extended positions.

58. An apparatus as in 53, the fingers movable between the run-in and extended positions by a spring device.

59. An apparatus for completing a well in a subterranean formation penetrated by a wellbore, the apparatus comprising:

a casing having a casing wall, the casing being expandable;

a plurality of perforations through the casing wall;

a plurality of plugs corresponding to the plurality of perforations, the plugs sealing the plurality of perforations;

a plurality of extendable fingers secured to the casing wall adjacent the plurality of the perforations, each of the fingers movable between a run-in position wherein the fingers do not interfere with the casing being run-in to the wellbore, and an extended position wherein the fingers project radially from the casing wall; and wherein each finger is pivotally attached to the casing wall.

60. An apparatus as in 59 wherein a wire extends from each finger, the wire for engaging the wellbore and moving the finger between the run-in and the extended positions.

61. An apparatus as in 59 the fingers movable between the run-in and extended positions by a spring device.

62. An apparatus as in 61 wherein the spring device is a torsion spring device.

63. An apparatus as in 59 wherein each fingers is movable between the extended position and a final position wherein each finger pierces a corresponding plug.

64. An apparatus as in 59 wherein each finger comprises an explosive charge for perforating the subterranean formation.

65. A well casing apparatus for a subterranean formation which is penetrated by a wellbore, the casing comprising:

a substantially tubular casing having a casing wall with a plurality of perforations therethrough;

a plurality of reactive plugs secured to the casing wall and sealing the plurality of perforations, wherein the casing is radially expandable when in the wellbore, and the plugs remain secured to the casing wall, sealing the plurality of perforations, when the casing is expanded in the wellbore; and wherein the reactive plugs expand in a prescribed geometric pattern in the presence of a pre-selected additive.

66. A well casing apparatus as in 65 wherein the reactive plugs comprise an elastomer.

67. A well casing apparatus as in 65 wherein the reactive plugs expand in the presence of diesel.

* * * * *